US009038301B2

(12) United States Patent
Zelbacher et al.

(10) Patent No.: US 9,038,301 B2
(45) Date of Patent: May 26, 2015

(54) ILLUMINABLE PANEL FRAME ASSEMBLY ARRANGEMENT

(71) Applicants: Erik G. Zelbacher, Lynn, MA (US); Rebecca C. Suciu, Lynn, MA (US); Thomas P. Burrous, Haverhill, MA (US); Paul F. Ellsworth, Burlington, MA (US); Alan L. Stenfors, Scituate, MA (US); Sidney Rose, Marblehead, MA (US)

(72) Inventors: Erik G. Zelbacher, Lynn, MA (US); Rebecca C. Suciu, Lynn, MA (US); Thomas P. Burrous, Haverhill, MA (US); Paul F. Ellsworth, Burlington, MA (US); Alan L. Stenfors, Scituate, MA (US); Sidney Rose, Marblehead, MA (US)

(73) Assignee: Rose Displays Ltd., Salem, MA (US)

( * ) Notice: Subject to any disclaimer, the term of this patent is extended or adjusted under 35 U.S.C. 154(b) by 0 days.

(21) Appl. No.: 13/986,248

(22) Filed: Apr. 15, 2013

(65) Prior Publication Data

US 2014/0305015 A1 Oct. 16, 2014

(51) Int. Cl.
*A47G 1/06* (2006.01)

(52) U.S. Cl.
CPC ..... *A47G 1/0622* (2013.01); *A47G 1/0611* (2013.01)

(58) Field of Classification Search
CPC ..... A47G 1/10; A47G 1/06; A47G 1/0605; A47G 1/0611; A47G 1/0622; G09F 1/12; G09F 15/0018; G09F 15/0006; G09F 15/0012; G09F 7/18
USPC ..... 40/790, 791, 792, 793, 611.12, 361, 40/782
See application file for complete search history.

(56) References Cited

U.S. PATENT DOCUMENTS

| | | | | |
|---|---|---|---|---|
| 3,310,901 | A * | 3/1967 | Sarkisian | 40/793 |
| 5,950,343 | A * | 9/1999 | Dingle | 40/793 |
| 6,729,057 | B1 * | 5/2004 | Lu | 40/611.02 |
| 6,823,618 | B2 * | 11/2004 | Huang | 40/575 |
| 2007/0204501 | A1 * | 9/2007 | Isayev et al. | 40/793 |

* cited by examiner

*Primary Examiner* — Joanne Silbermann
(74) *Attorney, Agent, or Firm* — Don Halgren

(57) ABSTRACT

A four sided illuminable frame arrangement for the convenient display of a planar article, the frame arrangement comprising an elongated inner rail receivably connected to an elongated outer rail, the outer rail having an elongated cover rail hingedly connected thereto, the three rails comprising a multi-component assembly for each side of the four sided frame arrangement, the elongated inner rail allowing for fastener-free capture of a light-transparent panel having an L-shaped first side which supports an elongated arrangement of LEDs, the inner rail also having a mounting bracket channel on the rear side thereof, and a second alignment bracket channel disposed thereadjacent, the second alignment bracket channels having upstanding panel-support-flanges for even, peripheral support of the aforementioned light-transparent panel thereon.

11 Claims, 11 Drawing Sheets

ILLUMINABLE PANEL FRAME ASSEMBLY ARRANGEMENT

BACKGROUND OF THE INVENTION

This invention relates to frame assemblies and more particularly to frame assemblies which are arrangeable to efficiently provide illumination of an easily replaceable display graphic within that frame assembly without mechanical fastener encumbrances.

PRIOR ART DISCUSSION

Multi-sided frame assemblies have been in commercial use for a number of years. These frame assemblies however are not necessarily arranged to permit an easy change of signage therewithin. Multi-sided frame assemblies which are illuminated from within, which are conveniently changeable in their display panels, are all the more rare.

Such readily changeable, illuminated signages or panels are very desirable for utilization with menu boards, fixtures, walls and in some cases they are hung from a ceiling.

It is an object of the present invention to overcome the disadvantages of the prior art.

It is a further object of the present invention to provide a multi-sided frame panel display arrangement which permits a unique, compact lighting configuration from within that panel display.

It is a further object of the present invention to provide a multi-sided frame panel display arrangement in which a display panel may be readily inserted from the front of the frame panel assembly.

It is yet a further object of the present invention to provide a multi-sided frame panel display arrangement which is easily assembled and contains light emitting fixtures conveniently and efficiently supported within the frame panel arrangement with minimal obtrusive wiring.

It is still a further object of the present invention to provide an illuminable panel that is readily assembled onto an inner tray and wherein the inner tray is readily assembled into an outer peripheral support assembly.

BRIEF SUMMARY OF THE INVENTION

The present invention in a first embodiment thereof comprises a four sided interlocking assembly of multi-component extrusions formed into, for example, a quadrilateral. Each of the sides are equivalent in cross-section and will be so described for ease of understanding. Each opposed side may be in further embodiments, of a different length than their adjacent side.

Each frame assembly side comprises an elongated extruded outer rail, an elongated extruded inner rail, an elongated extruded cover rail and an elongated, sinusoidally-shaped biasing spring.

The elongated extruded outer rail has a first elongated side and a second or "front-facing" elongated side of generally "J" shape in cross section. The elongated second side has an elongated distalmost edge comprising a cover rail -toe. The "J"-shaped second elongated side has an outer, elongated, curvilinear slide surface.

The elongated outer rail also comprises an "L"-shaped corner portion which defines its outer side and lowermost elongated edge. An elongated alignment bracket channel is formed inwardly adjacent of the outer side of the "L"-shaped corner portion. The spring receiving channel has an the oblique support base and an angled wall which is formed with a "J"-shaped cover engagement upper flange which extends off of the other side of the angled wall on the elongated outer rail. A first alignment bracket channel is disposed in the lower portion of the "L"-shaped corner portion of the outer rail. The first alignment bracket channel is defined by an inwardly extending flange on the inside of the outer wall of the "L"-shaped corner portion and the inwardly extending shoulder member on the inward side on the rearward or lowermost corner portion of the outer rail. A screw channel is disposed between the inner rail support shoulder and the oblique support base.

The elongated inner rail portion of each side of the frame assembly comprises an elongated side portion having a lower "L"-shaped edge which rests upon the inner rail support shoulder of the outer rail. The elongated side portion of the elongated inner rail has a first side on which an elongated array of light members are to be attached, further described hereinbelow. The elongated inner rail portion also comprises a mounting bracket channel which has a first or a lower "L"-shaped flange and a second "L"-shaped flange which permits the mounting bracket channel to be open towards the rear or back side of the frame assembly for receipt of a support member. The second "L"-shaped flange includes an elongated extended engagement lip. The elongated extended engagement lip extending from the inner rail acts to provide an edge for receipt of a different wall support member, or a surface for attaching another type of support member, if such need arises. The second "L"-shaped flange is attached to a further or second alignment bracket channel. The second alignment bracket channel is open to the "display" or front facing side of the frame assembly and consists of two "L"-shaped panel support flanges. These two "L"-shaped panel support flanges are arranged so as to provide a base for an acrylic panel on which a graphic or display sheet would subsequently be placed upon assembly of all side components therewith.

The assembled frame assembly is designed so as to be easily supportable on for example, a wall surface by a variety of different support members. For example, a generally "X"-shaped support member having two branches which are of stepped configuration and two other branches having mounting holes for attachment to the engagement lip which would permit support of the frame assembly on a secondary cleat secured to a wall.

A further support arrangement may be a threaded member having a head which slidably engages the mounting bracket channel. The head of the threaded member would be readily slid into the mounting bracket channel for example, and the threads would be fastened through a wall or panel. The threaded member would be inserted within the mounting bracket channel prior to final assembly of the inner frame into the outer frame members.

The invention thus comprises a four sided illuminated frame arrangement for the convenient display of a graphic article, the frame arrangement comprising: an elongated inner rail receivably connected to an elongated outer rail, the outer rail having an elongated cover rail hingedly connected thereto, the three rails comprising a multi-component assembly for each side of the four sided frame arrangement; wherein the outer rail includes a biasing-spring-supporting-channel, a first alignment bracket channel, and a threaded-member receiving-channel, the outer rail having an inner rail support shoulder along an inward edge thereof, wherein the elongated inner rail has an L-shaped first side in an abutting relationship with the inner rail support shoulder, the first side supporting an elongated arrangement of lights, the inner rail also having a mounting bracket channel on the rear side thereof, and a second alignment bracket channel disposed thereadjacent, the first and the second alignment bracket channels arranged so as to receive respective L-shaped connecting members between adjacent side assemblies of the frame arrangement, the. second alignment bracket channels having upstanding L-shaped panel-support-flanges for even peripheral support of a light transparent panel thereon. The four sided illuminable frame arrangement preferably includes a peripherally disposed electrical conduit channel or trough arranged immediately adjacent the mounting bracket channel in each elongated inner rail, for compact enclosure of a circuit for empowerment of the elongated arrangement of lights on the first side of the inner-rail. The four sided illuminable frame arrangement preferably includes an elongated sinusoidally configured biasing spring arranged within each respective biasing spring supporting channel. The elongated arrangement of lights on the first side of the inner rail are transversely adjacent and spaced apart from the light transparent panel disposed on the flanges of the second alignment bracket channel to permit light to enter sideways into the light transparent channel and to permit light to be reflected from the respective inner rails onto the rear side of the light transparent channel. The light transparent panel is maintained within the frame arrangement in a fastener-free orientation. The inner rail has both the rear facing elongated mounting bracket channel and an adjacent elongated securement member elongated lip from which to engage a frame assembly support member.

The invention also comprises an elongated outer side rail for a four sided illuminable frame arrangement to enable the conveniently changeable illuminated display of a planar article, the outer side rail comprising an elongated biasing spring supporting channel, an elongated first alignment bracket channel for connective receipt of a connector member, and an elongated generally omega-shaped threaded-member receiving-channel for receipt of a threaded member from an adjacent outer rail, the outer rail having an inner rail support shoulder along an inward edge thereof for aligned support of a further elongated rail component in a four sided illuminable frame arrangement.

The invention also comprises a four sided illuminable frame arrangement for the convenient display of a planar article, the frame arrangement comprising an elongated inner rail receivably connected to an elongated outer rail, the outer rail having an elongated cover rail hingedly connected thereto, the three rails comprising a multi-component assembly for each side of the four sided frame arrangement; wherein the outer rail includes a biasing spring supporting channel, a first alignment bracket channel, and a threaded-member receiving-channel, the outer rail having an inner rail support shoulder along an inward edge thereof, wherein the inner rail has mating "L" shaped portions to enable close supportive relationship between the elongated outer rail and the elongated inner rail of each respective side rail assembly, and wherein each inner rail includes an elongated LED supporting edge and an electrical circuit capturing trough collectively cooperating in the frame assembly to enable multiple-end-to-end connectivity between adjacent elongated LED lights in adjacent side rail assemblies.

The invention also includes a four sided, illuminable, sequentially assembled frame arrangement for the convenient display of a planar article, the frame arrangement comprising: a four sided inner rail assembly comprised of four inner rail members, wherein each inner rail side member thereof comprises an elongated outer side wall having a mid-level, "L" shaped support-receiving edge thereon, and an alignment bracket channel comprised of two "L" shaped panel support flanges for receipt of a display support panel, which between them connectively define a wire-receiving trough, the elongated outer side wall having an inner facing LED light receiving portion for attachment of a panel illuminating LED arrangement; a four sided outer rail assembly comprised of four outer rail members, wherein each outer rail member thereof comprises an elongated outer side having an upper "J" shaped cover receiving hinge arrangement and a lowermost alignment bracket receiving channel, wherein the lowermost bracket receiving channel includes an "L" shaped corner portion comprising an inner rail support shoulder; wherein the four rail inner rail assembly has a illuminable panel supported thereon, and wherein the four sided inner rail assembly and illuminable panel is nestled on a contiguously arranged array of inner rail support shoulders, wherein the outer rail also includes a biasing spring supporting channel, a first alignment bracket channel, and a threaded-member receiving-channel, the inner rail assembly and the outer rail assembly permitting the stepped nestable assembly of the four sided frame arrangement. The four sided illuminable sequentially assembled frame arrangement preferably includes an elongated array of LED lights attached to the inwardly facing light receiving portion of at least one of the four inner rail members. Each inner rail member preferably includes a wire receiving trough for maintaining a electrical power supplying wire for the LED lights arranged on the at least one light receiving portion of at least one of the four inner rail members.

The invention also includes a four sided illuminable sequentially assembled frame arrangement for the convenient display of a planar article, the frame arrangement comprising an elongated inner rail receivably connected to an elongated outer rail, the outer rail having an elongated cover rail hingedly connected thereto, the three rails comprising a multi-component assembly permitting sequential assembly of the four sided frame arrangement, wherein the outer, rail includes a biasing spring supporting channel, a first alignment bracket channel, and a threaded-member receiving-channel, the outer rail having an inner rail support shoulder along an inward edge thereof, wherein the elongated inner rail has an L-shaped first side in an abutting relationship with the inner rail support shoulder, the first side arranged so as to support an elongated arrangement of lights, the inner rail also having a mounting bracket channel on the rear side thereof, and an alignment bracket channel disposed thereadjacent, the alignment bracket channels arranged so as to receive respective L-shaped connecting members between adjacent side assemblies of the frame arrangement, the second alignment bracket channels having upstanding L-shaped panel-support-flanges for even peripheral support of a light transparent panel thereon, and including a peripherally disposed electrical conduit channel arranged properly adjacent the mounting bracket channel in each elongated inner rail, for compact enclosure of a circuit for empowerment of the elongated arrangement of lights on the first side of the inner-rail. The frame arrangement includes an elongated sinusoidally configured biasing spring arranged within each respective biasing spring supporting channel. The elongated arrangement of lights on the first side of the inner rail are transversely adjacent and spaced apart from the light transparent panel disposed on the flanges of the second alignment bracket channel to permit light to enter sideways into the light transparent panel. The light transparent panel is maintained within the frame arrangement in a fastener-free orientation. The inner rail preferably has both the rear facing elongated mounting bracket channel and an adjacent elongated securement member elongated lip from which to engage a frame assembly support member.

The invention also includes a four sided illuminable frame arrangement for the convenient display of a planar article, the frame arrangement comprising: an elongated inner rail receivably connected to an elongated outer rail, the outer rail having an elongated cover rail hingedly connected thereto, the three rails comprising a multi-component assembly for each side of the four sided frame arrangement wherein the outer rail includes a biasing spring supporting channel, a first alignment bracket channel, and a threaded-member receiving-channel, the outer rail having an inner rail support shoulder along an inward edge thereof, wherein the inner rail has mating "L" shaped portions to enable close supportive relationship between the elongated outer rail and the elongated inner rail, and wherein each inner rail includes an elongated LED supporting edge and an electrical circuit capturing trough collectively cooperating in the frame assembly to enable orderly, multiple electrical circuit connectivity with adjacent side rail assemblies.

The invention also includes an elongated outer side rail for a four sided illuminable frame arrangement to enable the conveniently changeable illuminated display of a planar article, the outer side rail comprising an elongated biasing spring supporting channel, an elongated first alignment bracket channel for connective receipt of a connector member, and an elongated opening, one embodiment shown as a generally Omega-shaped threaded-member receiving-channel for receipt of a threaded member from an adjacent outer rail, the outer rail having an inner rail support shoulder along an inward edge thereof for aligned support of a further elongated rail component in a four sided illuminable frame arrangement.

The invention also includes a method of assembly of a four sided frame arrangement comprising one or more of the steps of: arranging a connected assembly of four inner rail members, attached to one anther at their contiguous ends; placing an elongated set of LED lights onto an elongated inwardly directed side portion of at least one of the inner rail members comprising the connected assembly; supporting an illuminable panel on an upwardly directed portion of an alignment bracket channel of each inner rail member; placing the connected assembly of four inner rail members and the illuminable panel onto an assembly of four connected outer rail members; and connecting the four outer rail members by alignment brackets and threaded members, so as to secure the inner and the outer connected assemblies together into an illuminable panel display arrangement; arranging an elongated pivotable cover rail into an elongated hinge arrangement on an upper edge of each of the outer rail members, so as to permit a display to be pivotably secured to an upper side of the illuminable panel; placing an electrical wire in connected with the LED lights, into a four sided trough in each of the inner rail members; the method including: supporting the illuminable panel in transverse alignment with the set of lights; surrounding the illuminable panel by a connected set of lights transversely and peripherally therearound; and maintaining the illuminable panel in fastener-free place by contact with an inwardly directed surface of the second side of the outer rail.

BRIEF DESCRIPTION OF THE DRAWINGS

The objects and advantages of the present invention will become more apparent, when viewed in conjunction with the following drawings, in which:

FIG. 8 is a perspective view of a support fixture utilizable with the frame assembly of the present invention to enable that frame assembly to be attached to a wall or the like;

DETAILED DESCRIPTION OF THE PRESENT INVENTION

Figure 1:
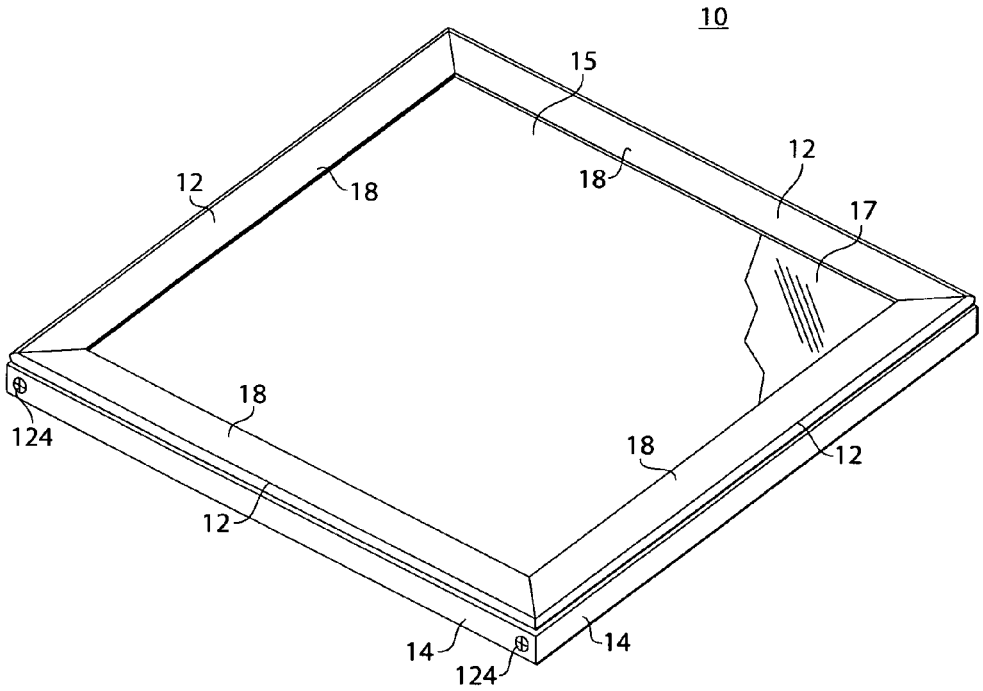
FIG. 1 is a perspective view of a frame assembly constructed according to the principles of the present invention.

The present invention in a first embodiment thereof comprises a four sided interlocking frame assembly 10 of multi-component extrusion sides 12 are formed into, for example, a sequentially assembled quadrilateral frame assembly, as represented in final form in FIG. 1, which peripherally enclose a glass or plastic (acrylic) light-transmitting panel 15, which panel 15 supports a display graphic 17. The frame assembly has a front face shown in FIG. 1 and a rear or back face shown in FIG. 4. In one preferred embodiment, a pair of frame assemblies may be attached to one another, back face to back face for support from an overhead support.

Each of the sides 12 of the frame assembly 10 are equivalent in cross-section and will be so described for ease of understanding. Each opposed side 12 may be in further embodiments, of a different length than their adjacent side, with their abutting end portions cut diagonally as appropriate.

Figure 2:
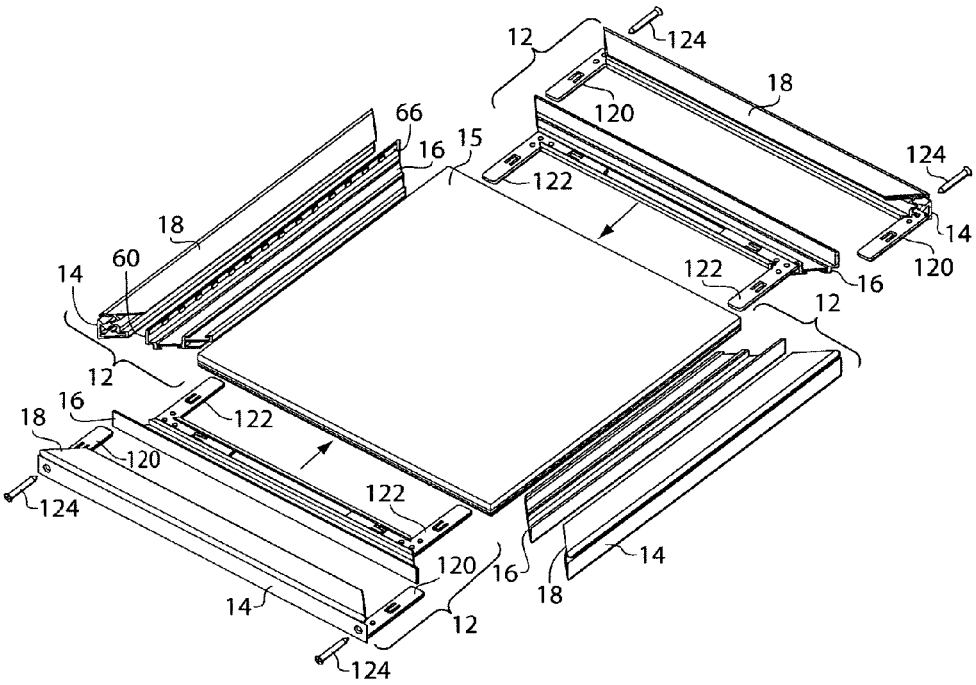
FIG. 2 is a perspective exploded view showing the side rail assemblies with a panel arranged therebetween.
Figure 5:
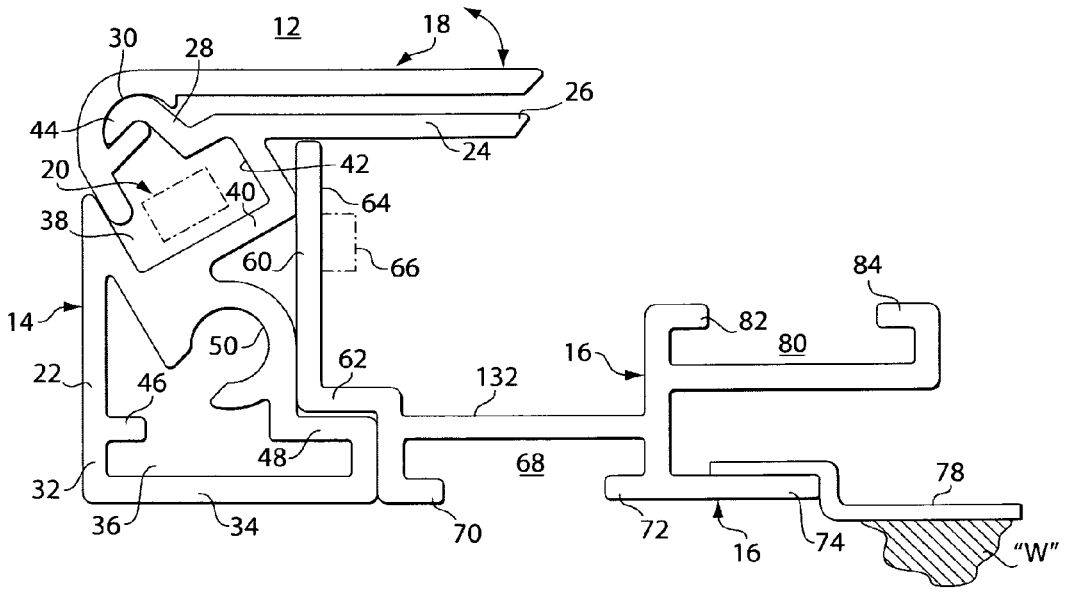
FIG. 5 is an end view of a side assembly of the frame constructed according to the principles of the present invention.
Figure 6:
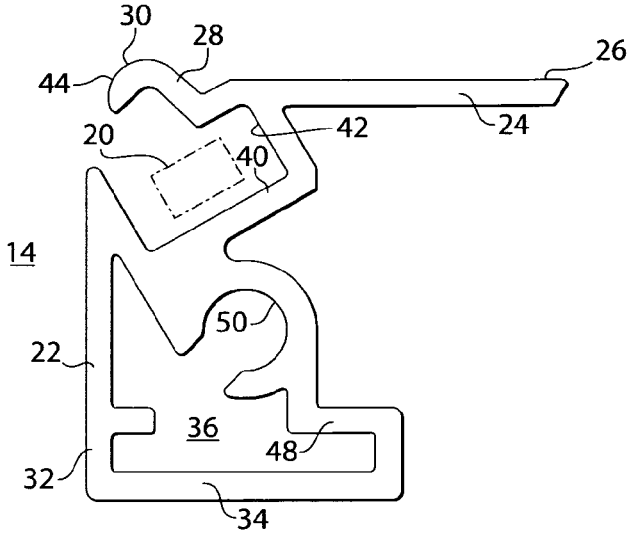
FIG. 6 is an end view of the outer rail portion of a side assembly of the frame constructed according to the principles of the present invention.
Figure 7:
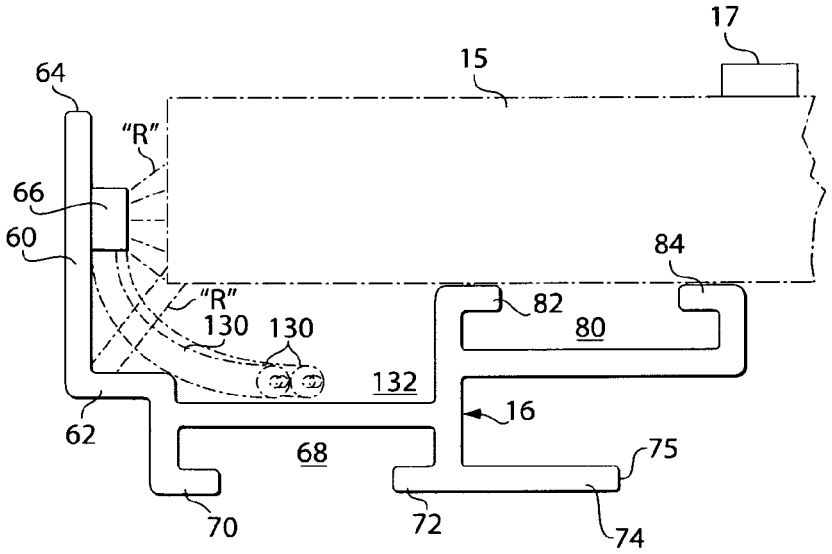
FIG. 7 is an end view of the inner rail portion of a side assembly of the frame constructed according to the principles of the present invention.

Each side 12 of the frame assembly 10 comprises an elongated extruded outer rail 14, shown in FIGS. 1, 2, 5 and 6, an elongated extruded inner rail 16, shown in FIGS. 2, 5 and 7, an elongated extruded cover rail 18, shown in FIGS. 1, 2 3 and 5, (as well as in U.S. Pat. No. 8,196,325 incorporated by reference), and an elongated, sinusoidally-shaped biasing spring 20, shown in FIG. 5, (and in the above-identified '325 Patent).

The elongated extruded outer rail 14 has a first elongated side 22 and a second elongated side 24 which second or upper side 24 is of generally "J" shape in cross section. The elongated second side 24 has an elongated distalmost edge comprising a cover rail toe 26. The "J"-shaped second elongated side 28 has an outer, elongated, curvilinear slide surface 30.

The elongated outer rail 14 also comprises an "L"-shaped corner portion 32 which defines its outer side 22 and a back or rear facing lowermost elongated edge 34. An elongated alignment bracket channel 36 is formed inwardly adjacent of the side of the "L"-shaped corner portion 32. An obliquely disposed cover-edge-and-spring-receiving channel 38 has an oblique support base 40 and an angled wall 42 which is formed with a "J"-shaped cover engagement upper flange 44 which extends off of the other side of the angled wall 42 on the elongated outer rail 14, as best represented in FIGS. 5 and 6.

The first alignment bracket channel 36 is disposed in the lower portion of the "L"-shaped corner portion 32 of the outer rail 14, as shown in FIGS. 5 and 6. The first alignment bracket channel 36 is defined by an inwardly extending side flange 46 on the inside of the outer wall 22 of the "L"-shaped corner portion 32 and the inwardly extending shoulder member 48 on the inward side of the back facing edge 34 of the outer rail 14. The shoulder member 48 also functions as an elongated support for an "L" shaped lower edge 62 of an inner rail 14, described further hereinbelow. A screw channel 50 is disposed between the inner rail support shoulder 48 and the oblique support base 40, to enable securement receiving means 124 between adjacent frame side portions 12, as shown in FIGS. 1, 2, 3 and 4.

Figure 3:
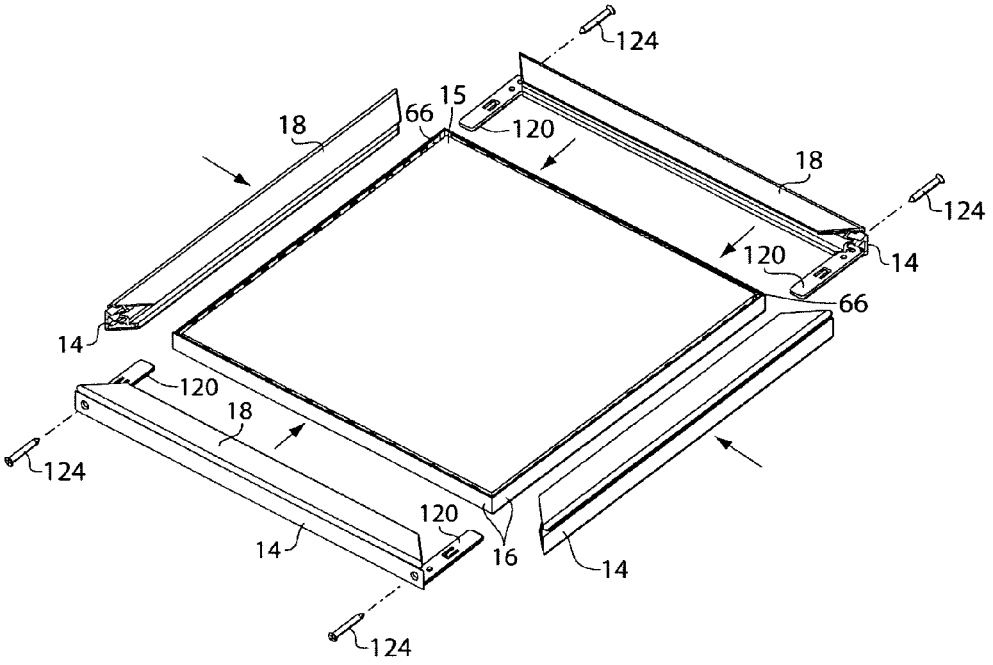
FIG. 3 is a perspective exploded view generally similar to FIG. 2 with several of the side assemblies already mated about the central panel, which are shown unassembled in FIG. 2.
Figure 3A:
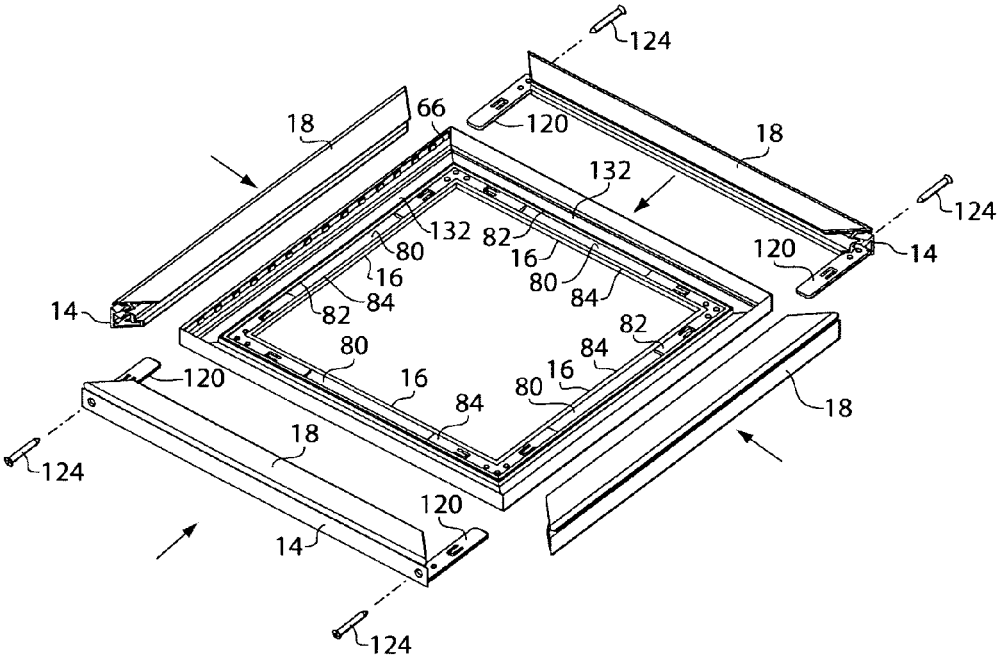
FIG. 3A is a view similar to FIG. 3 without the panel being shown supported within or on the inner frame.
Figure 4:
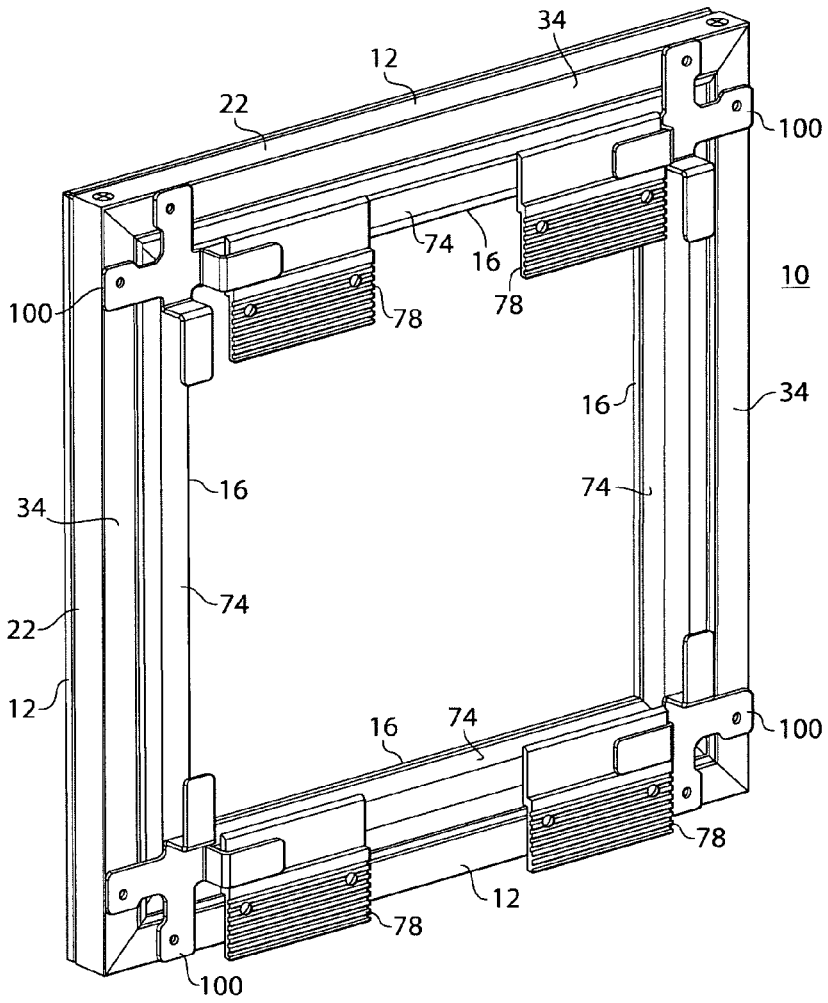
FIG. 4 is a perspective view of the rear side of the frame assembly constructed according to the principles of the present invention, showing several support members attached thereto to enable the frame assembly to be attached and supported on a wall.
Figure 5A:
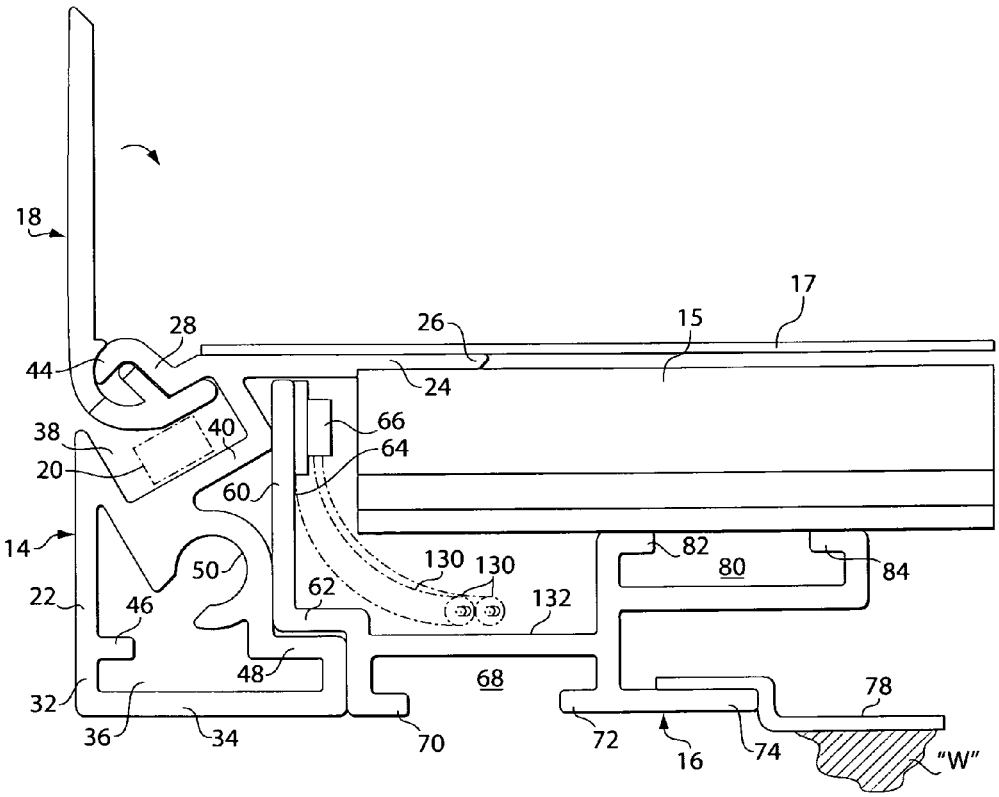
FIG. 5A is a cross sectional view of the inner frame assembly supporting a panel, which inner frame is shown dropped into and received by the outer frame, with the upper flange in an opened display receiving orientation.

The elongated inner rail portion 16 of each side of the frame assembly 12, as shown in FIG. 7, comprises an elongated side portion 60 having an elongated mid-level "L"-shaped support-receiving edge 62 which rests upon the inner rail support providing support shoulder 48 of the outer rail 14, as represented in FIG. 5. The elongated side portion 60 of the elongated inner rail 16 has a first side 64 on which an elongated array of electronically charged light members 66 are easily adhesively attached, further described hereinbelow. The elongated inner rail portion 16 also comprises a rearwardly open mounting bracket channel 68 which has a first or a lowermost "L"-shaped flange 70 and a second "L"-shaped flange 72 which thus permits the mounting bracket channel 68 to be open towards the backside (bottom as shown in FIGS. 5 and 7) of the frame assembly 10. The second "L"-shaped flange 72 includes an elongated extended engagement lip 74 extending transversely therefrom. The elongated extended engagement lip 74 extending from the inner rail 16 acts to provide an edge 75 for receipt of a wall support member 78, as represented in FIGS. 5 and 5A, or acts as a surface for attaching another type of support member, 100, later described. The second "L"-shaped flange 72 is contiguous to a further or second alignment bracket channel 80, as represented in FIGS. 5 and 7. The second alignment bracket channel 80 is open to the "display" side of the frame assembly 10 and consists of two "L"-shaped panel support flanges 82 and 84. These two "L"-shaped panel support flanges 82 and 84 are arranged so as to provide a support base for the acrylic light transmitting panel 15, as represented in FIG. 7, on which a then illuminated informational display sheet 17 would subsequently be placed upon the full frame assembly 10 of all side components 12 joined therewith, shown in sequence in FIGS. 2 and 3 to a finished product display, as shown in FIGS. 1 and 4.

Figure 8:
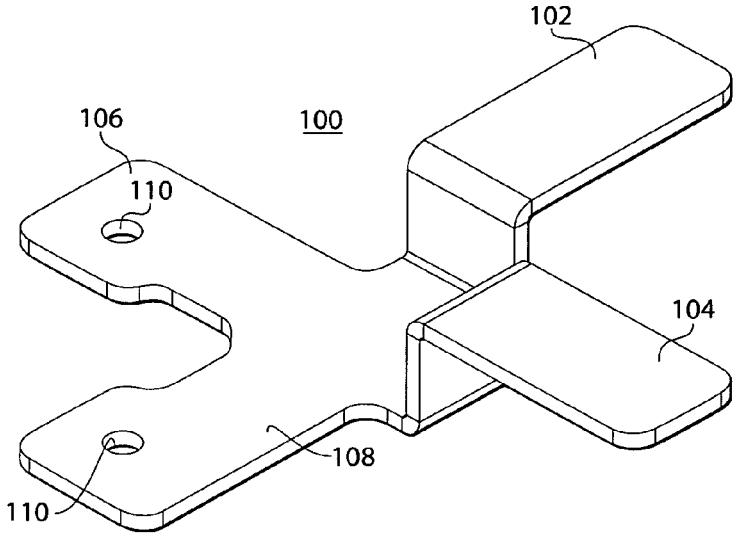
Figure 9:
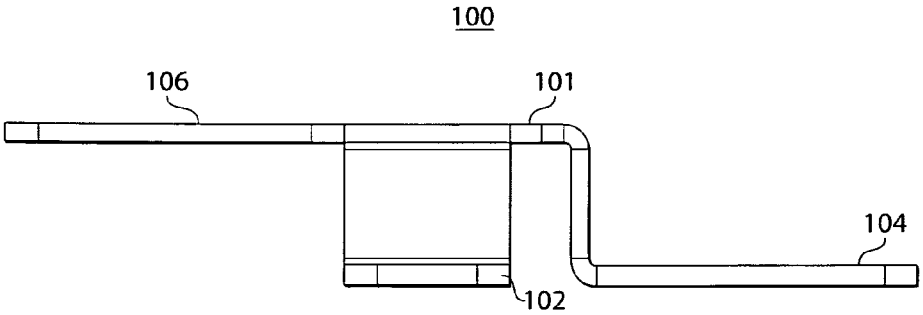
FIG. 9 is a side elevation view of the support fixture are presented in FIG. 8.
Figure 10:
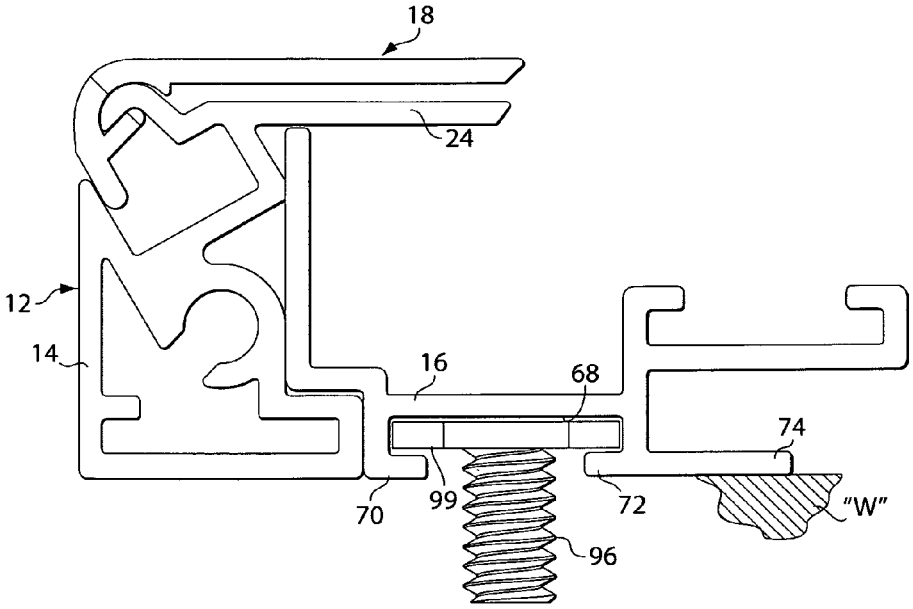
FIG. 10 is a side elevation of view of one section of the frame assembly utilizing a further wall support arrangement therewith.

The assembled frame assembly 10 is designed so as to be easily supportable on for example, a wall surface "W" by a variety of different support members 96, one of which is represented in FIG. 10. A further support member example is shown in FIGS. 4, 8 and 9, with a generally "X"-shaped support member 100 having a central hub 101 with two branches 102 and 104 which are of stepped configuration and two other branches 106 and 108 having mounting holes 110 for attachment to engagement lip 74 which would permit support of frame assembly 10 on a secondary cleat secured to a wall "W". Such attachment of the support member 100 is represented in FIG. 4.

A further support arrangement may be the threaded member 96 having a head 99 which slidably engages the mounting bracket channel. The head 99 of the threaded member 96 would be readily slid into the mounting bracket channel 68 for example, and the threads would be fastened through a wall or panel "W". The threaded member 96 being slid into the mounting bracket channel 68 prior to the outer rail members 14 being attached to the inner rail members 16.

FIG. 2 represents a sequence of steps in the assembly process wherein L-shaped connector brackets 120 are arranged in the end portions of the second alignment bracket channel 80 of opposed inner rail arrangements 16 and are inserted into adjacent second alignment bracket channels 80 in adjacent side inner rail assemblies 16. This then comprises the inner rail assembly. The LED lights 66 would be attached to the elongated space 64 on the rail 16, and the LED electrical power wires 130 would be arranged in the contiguous four troughs 132, shown outwardly adjacent its respective neighboring bracket channel 80 in FIG. 5A, the power wires arranged for passage out through a grommeted side opening, not shown for clarity of viewing. FIG. 3 also represents the outer rail assemblies 14 having L-shaped connector brackets 122 being inserted into the respective first alignment bracket channels 36 in adjacent side rail assemblies to form the second portion of the full frame assembly 10 as represented in FIG. 1. Two sets of threaded fasteners 124 are shown in FIGS. 2 and 3, which fasteners 124 extend through the outer wall 22 of opposed pairs of the outer rail assemblies 14 and into the screw channel 50 on a respectively adjacent side rail assembly 12 to make the final product once the four sided inner rail assembly 16 now supporting a panel 15 is nestably fitted onto the four contiguous shoulders 48 of the four contiguous sides comprising the outer rail assembly 14.

Elongated strips of controllable energy emmitance and color controllable light emitting diodes (LEDs) 66 may be seen in FIG. 2 and in FIGS. 3 and 5A wherein the lights 66 preferably peripherally surround and are transversely adjacent the panel 15 as represented in FIG. 5A, so as to emit light "R" reflectively from the back side of and/or towards the side portions of the acrylic panel 15 nestled within the side frame assemblies 12, as represented in FIG. 7, and held in place, fastener-free, by the inwardly (downwardly) facing second side 24 of the outer rail 14, as represented in FIG. 5A . A proper, peripherally disposed connecting-circuit 130 for enabling end-to-end connectivity between adjacent LED arrangements, and for controlling and empowering the light emitting diodes 66 may be arranged within an electrical wire-receiving trough 132 on each of the inner rail members 16, (the LEDs requiring electrical connectivity at one or both of their respective ends in each inner rail), conveniently disposed in the elongated space immediately above the respective mounting bracket channels 68, as represented in FIG. 7, a power cable extending out a port, not shown, to a power source, also not shown. The assembly of the four inner rails 16 and hence the four wire-receiving troughs 132 thus comprising a four sided peripheral channel for the LED power supply wires 130 once the inner rail members 16 are pre-assembled together with one another, as may be envisioned in FIG. 2. Battery empowerment above those mounting bracket channels is an alternative empowerment embodiment for the LEDs.

The display graphic 17 is placed upon the panel 15 when the respective cover rails 18 have been lifted angularly "A" into an upright orientation "U" as represented in FIG. 5A, when the panel 15 rests upon the rectilinear array of adjacently connected base rail support flanges 82 and 84 as shown in FIG. 5A. Such displays 17 may be readily changed by merely pivoting those cover rails 18 upwardly to permit such display change, and allow their clear or color controlled lit enhancement.

The invention claimed:

1. A four sided illuminable sequentially assembled frame arrangement for the convenient display of a planar article, the frame arrangement comprising:

an elongated inner rail receivably connected to an elongated outer rail, the outer rail having an elongated cover rail hingedly connected thereto, the three rails comprising a multi-component side assembly permitting sequential assembly of the four sided frame arrangement;

wherein the outer rail includes a biasing spring supporting channel, a first alignment bracket channel, and a threaded-member receiving-channel, the outer rail having an inner rail support shoulder along an inward edge thereof;

wherein the elongated inner rail has an L-shaped first side in an abutting relationship with the inner rail support shoulder of the outer rail, the first side of the elongated inner rail supporting an elongated arrangement of lights, the inner rail also having a mounting bracket channel on the rear side thereof, and a first alignment bracket channel disposed thereadjacent, the alignment bracket channel arranged so as to receive respective L-shaped connecting members between adjacent side assemblies of the frame arrangement, and a second alignment bracket channels having upstanding panel-support-flanges so as to enable peripheral support of a light transparent panel thereon.

2. The four sided illuminable frame arrangement as recited in claim 1, including a peripherally disposed electrical conduit channel arranged outwardly adjacent the mounting bracket channel in each elongated inner rail, for compact enclosure of a circuit for empowerment of the elongated arrangement of lights on the first side of the inner-rail.

3. The four sided illuminable frame arrangement as recited in claim 2, wherein the light transparent panel is maintained within the frame arrangement in a fastener-free orientation.

4. The four sided illuminable frame arrangement as recited in claim 2, wherein the inner rail has both the rear facing elongated mounting bracket channel and an adjacent elongated securement member elongated lip from which to engage a frame assembly support member.

5. The four sided illuminable frame arrangement as recited in claim 2, wherein the elongated arrangement of lights on the first side of the inner rail are transversely adjacent and spaced apart from the light transparent panel disposed on the flanges of the second alignment bracket channel to permit light to enter sideways into the light transparent panel.

6. The four sided illuminable frame arrangement as recited in claim 2, including an elongated sinusoidally configured biasing spring arranged within each respective biasing spring supporting channel.

7. A four-sided illuminable, sequentially-assembled frame arrangement for the convenient display of a planar article, the frame arrangement comprising:

a four sided inner rail assembly comprised of four inner rail members, wherein each inner rail side member thereof comprises an elongated outer side wall having a mid-level, "L" shaped support-receiving edge thereon, and an alignment bracket channel comprised of two panel support flanges for receipt of a display support panel, which between them connectively define a wire-receiving trough, the elongated outer side wall having an inner facing LED light receiving portion for attachment of a panel illuminating LED arrangement;

a four sided outer rail assembly comprised of four outer rail members, wherein each outer rail side member thereof comprises an elongated outer side having an upper "J" shaped cover receiving hinge arrangement and a lowermost alignment bracket receiving channel, wherein the lowermost bracket receiving channel includes an "L" shaped corner portion comprising an inner rail support shoulder;

wherein the four rail inner rail assembly has a illuminable panel supported thereon, and wherein the four rail inner rail assembly and illuminable panel is nestled on a contiguously arranged array of inner rail support shoulders which are defined by a pair of second alignment bracket flanges, and wherein the outer rail also includes a biasing spring supporting channel, a first alignment bracket channel, and a threaded-member receiving-channel for permitting the stepped assembly of the four sided frame arrangement.

8. The four-sided illuminable sequentially assembled frame arrangement as recited in claim 7, including an elongated array of LED lights attached to the inwardly facing light receiving portion of at least one of the four inner rail members.

9. The four-sided illuminable sequentially assembled frame arrangement as recited in claim 8, wherein each inner rail member includes the wire receiving trough for maintaining a electrical power supplying wire for the LED lights arranged on the at least one light receiving portion of at least one of the four inner rail members.

10. A four sided illuminable frame arrangement for the convenient display of a planar article, the frame arrangement comprising:

an elongated inner rail receivably connected to an elongated outer rail, the outer rail having an elongated cover rail hingedly connected thereto, the three rails comprising a multi-component assembly for each side of the four sided frame arrangement; wherein the outer rail includes a biasing spring supporting channel, a first alignment bracket channel, and a threaded-member receiving-channel, the outer rail having an inner rail support shoulder along an inward edge thereof, wherein the inner rail has mating "L" shaped portions to enable close supportive relationship between the elongated outer rail and an elongated "L"-shaped LED supporting edge of the elongated inner rail, and wherein each inner rail includes the elongated "L"-shaped LED supporting edge and an electrical circuit capturing trough collectively cooperating in the frame assembly to enable orderly, multiple electrical circuit connectivity between adjacent side rail assemblies, wherein each outer rail is connected to an adjacent outer rail by an alignment bracket insertively connected through their respective alignment bracket channels.

11. An extruded elongated outer side rail for a four sided illuminable frame arrangement to enable the conveniently changeable illuminated display of a planar article, the extruded elongated outer side rail comprising an elongated biasing spring supporting channel, an elongated first alignment bracket channel for connective receipt of a connector member, and an adjacent-outer-rail elongated threaded-member receiving-channel for receipt of a threaded member from an adjacent outer rail, the extruded elongated outer rail having an inner rail support shoulder along an inward edge thereof for aligned support of a further elongated inner rail component in a four sided illuminated frame arrangement.

* * * * *